United States Patent [19]

Fehrer

[11] 3,981,137

[45] Sept. 21, 1976

[54] METHOD OF SPINNING TEXTILE FIBERS

[76] Inventor: Ernst Fehrer, Auf der Gugl 28, Linz, Austria

[22] Filed: May 5, 1975

[21] Appl. No.: 574,264

[30] Foreign Application Priority Data

May 30, 1974 Austria ..... 4497/74

[52] U.S. Cl. ..... 57/156; 19/150; 57/58.89; 57/58.95

[51] Int. Cl.[2] ..... D01H 1/12

[58] Field of Search ..... 57/58.89–58.95, 57/50, 156; 19/150, 157

[56] References Cited

UNITED STATES PATENTS

| | | | |
|---|---|---|---|
| 2,202,118 | 5/1940 | Newman et al. | 57/58.91 UX |
| 2,220,024 | 10/1940 | Pool | 57/58.91 X |
| 2,227,911 | 1/1941 | Pool | 57/58.91 X |
| 2,258,661 | 10/1941 | Pool | 57/58.91 X |
| 2,363,470 | 11/1944 | Lannan et al. | 57/58.89 UX |
| 2,808,697 | 10/1957 | Williams | 57/58.95 |
| 3,330,008 | 7/1967 | Schuller | 57/58.91 X |
| 3,343,360 | 9/1967 | Brown | 57/58.91 |
| 3,635,006 | 1/1972 | Fehrer | 57/156 X |
| 3,636,693 | 1/1972 | Benson et al. | 57/58.95 |

*Primary Examiner*—John Petrakes
*Attorney, Agent, or Firm*—Kurt Kelman

[57] ABSTRACT

An air stream is caused to impinge on a collecting surface disposed in a sharply defined suction zone. Fibers having a predetermined maximum length are entrained by said air stream to cause said fibers to be delivered to and form a condensed sliver on said collecting surface. Air is sucked in said suction zone at a rate which is approximately as large as the rate of said air stream. Said condensed sliver is drawn from said collecting surface and is subsequently twisted to form a thread. Said thread is drawn off while being held against rotation. The suction zone has in the direction in which said condensed sliver is drawn off a dimension which is approximately as large as the maximum length of said fibers. The suction zone has at right angles to said direction a dimension which is approximately as large as the diameter of said condensed sliver.

2 Claims, 3 Drawing Figures

FIG. 1
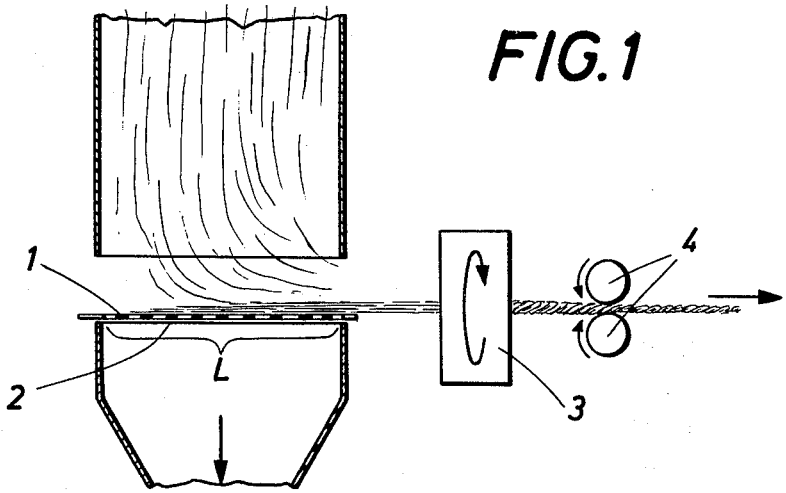
FIG. 3
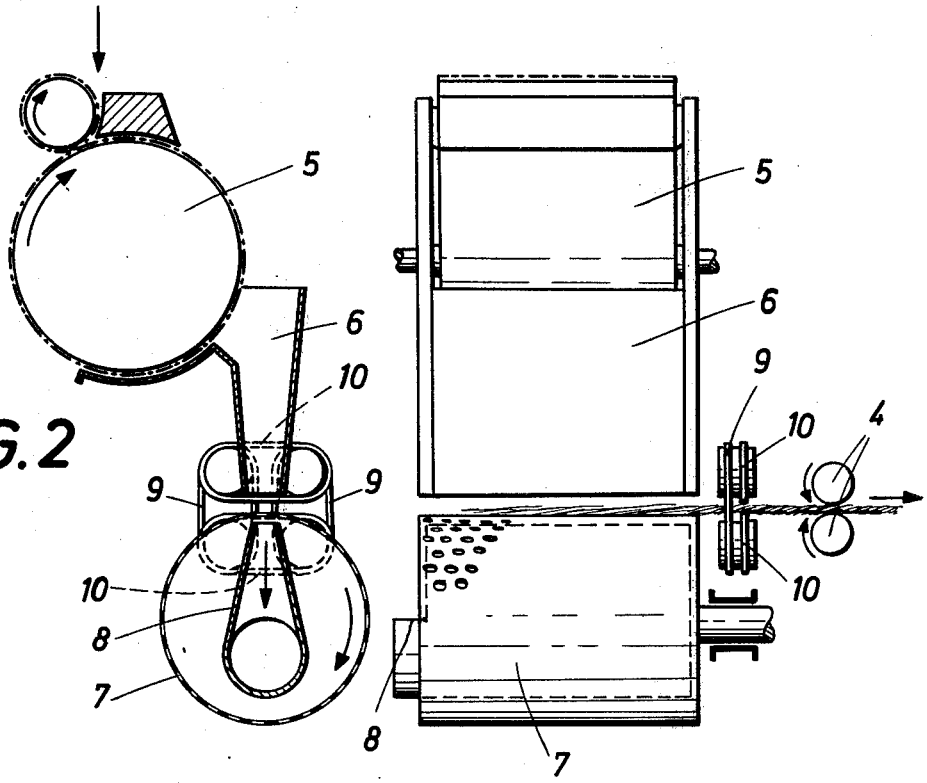
FIG. 2

METHOD OF SPINNING TEXTILE FIBERS

This invention relates to a method of spinning textile fibers, in which the fibers are entrained by an air stream and are subsequently mechanically twisted together and are drawn off as a thread while being held against rotation.

In a known method of this kind the individual fibers are blown into a shallow groove formed in a table, and an endless belt extending transversely to said groove revolves over said table. That method relies on the fact that a fibrous structure can be twisted together or spun between two surfaces which are moved relative to each other, provided that the moving surfaces are succeeded by draw-off means, which continuously draws off the fibrous structure transversely to the direction of movement of said surfaces and holds the fibrous structure against rotation at the same time and that the fibers approaching the moving surfaces can freely perform the movement which is forcibly imparted to them by these surfaces. The grooved table and the endless belt moving over the table may be replaced by two parallel superimposed endless belts, which revolve in the same sense and whose confronting courses forms the surfaces that move transversely to the longitudinal direction of the thread. In that case the material is fed to the belts on one longitudinal side of the latter and is drawn off through an eyelet or the like on the other longitudinal side. That method has the advantage that the fibers can be twisted together at high speed and for this reason the thread is very small in diameter and the belts can move at speeds that can well be controlled whereas the rolling of the thin thread on the belt which moves over the thread nevertheless results in a high spinning speed. On the other hand it has been found that great difficulties are involved in practice in the feeding of the fibers, particularly because the blowing air is not properly exhausted and the fibers in the groove in the table or between the moving endless belts are virtually agitated by the following-up air stream.

In another known method the fibers are tangently blown into a hollow drum rotating at high speed or into similar means by a unit which disintegrates the fed material into individual fibers and the fibers collect initially on the inside peripheral surface of the drum under the action of centrifugal force and are then centrally drawn off out of said drum to form a thread. The apparatus required to perform said method involves a relatively high structural expenditure. A higher degree of twisting requires a correspondingly high speed of the drum. On the other hand, a limitation is imposed as regards the speed of the drum for structural reasons because the mass of the drum is relatively large.

For this reason it is an object of the invention to eliminate these disadvantages and to provide a method which is of the kind described first hereinbefore and which permits of a spinning to a very high twist and at a correspondingly high draw-off speed whereas a complicated apparatus comprising parts which have a large mass and are moved at high speed is not required.

In the method according to the invention this object is accomplished in that the fibers are caused to approach a collecting surface which precedes the twisting point and is included in a sharply defined suction zone, the approaching fibers are caused to form a condensed sliver on said collecting surface and said condensed sliver is drawn off and twisted together, the length of the suction zone in the direction in which the fibers are drawn off is approximately as large as the maximum length of said fibers, and the width of the suction zone is approximately as large as the diameter of the condensed sliver, and air is sucked in the suction zone at rate which is substantially as large as the rate of the entraining air stream.

Once the condensed sliver has been formed, it can easily be twisted together by means of a simple twisting tube or by two endless belts whose confronting courses move in opposite directions. Whereas the rotation of the twisting tube or the movement of the endless belts must be performed at high speed so that the required twist is obtained even when the thread is drawn off at high speed, the dimensions and masses of such mechanical twisting means may be so small that even when the twisting means are operated at high speeds there will be no difficulties as regards the bearings or the like. The success of this operation depends on the fact that the fibers or the condensed sliver formed by them are not or is not prevented from performing the movement which is forcibly imparted to the fibers or condensed sliver by the twisting means. For this reason the friction between the condensed sliver and the collecting surface in contact therewith must be minimized. To meet this requirement, the length over which the condensed sliver is in contact with the collecting surface or extends in the suction zone should be only as large as the maximum length of the fibers. The width of the suction zone should also be minimized not to exceed the diameter of the sliver and the suction must be minimized, too, to the amount of the entrained air to ensure that the suction does not retain the fibers on the collecting surface. Only the compliance with these requirements precludes the presence of a friction which is so high that the condensed sliver is more or less held against rotation on the collecting surface. This would result in a false twisting so that the total twist which can be achieved would be much reduced.

The movement of the condensed sliver adjacent to the suction zone may be assisted in that, in accordance with a further feature of the invention, the collecting surface is continuously moved to assist the rolling of the condensed sliver on said surface in the sense of the subsequent twisting.

The method according to the invention will be explained more fully with reference to the accompanying drawing, in which FIG. 1 is a diagrammatic view showing apparatus for carrying out the method and FIGS. 2 and 3 are, respectively, an end elevation and a side elevation showing another embodiment of such apparatus.

In the apparatus of FIG. 1, the fibers entrained in an air stream are applied to a perforated collecting surface 1 in a suction zone 2 which has a length L that is approximately the same as the maximum length of the fibers. The width of the suction zone 2 is small and approximately the same as the diameter of the condensed sliver which is formed on the collecting surface 1. Schematically shown twisting device 3 is succeeded by a pair of draw-off rollers 4 which continuously draw off the thread that has been formed and which hold the thread against rotation. The rate at which air is sucked off in the suction zone 2 is substantially as large as the rate of the air stream in which the fibers are entrained.

In the embodiment of FIGS. 2 and 3, the material to be spun is disintegrated by a serrated drum 5 to form individual fibers which are ejected and by the air stream that is due to the rotation of the drum are entrained into a well 6. The collecting surface is formed by a shell 7 of a rotating suction drum which contains a suction insert 8. The latter tapers toward the mouth of the well 6 to define the suction zone 2. The twisting device consists of two crossing pairs of endless belts 9, 10. The confronting courses of the belts of each pair move in mutually opposite directions so that the condensed sliver is spun to form a thread which is then drawn off by the pair of draw-off rollers 4.

What is claimed is:

1. A method of spinning textile fibers, which comprises 1. causing a stream of a predetermined amount of air to impinge on an air-permeable collecting surface disposed in a sharply defined suction zone,
2. entraining textile fibers having a predetermined maximum length by the air stream to cause the fibers to be delivered to the collecting surface and to form a sliver thereon, 3. sucking approximately the same amount of air through the collecting surfaces as the amount of air in said stream,
4. drawing the sliver from the collecting surface in a predetermined direction,
   a. the length of the suction zone in said direction being approximately the same as the maximum length of the fibers and
   b. the width of the suction zone perpendicular to said direction being approximately the same as the diameter of the sliver,
5. twisting the sliver after it has been drawn from the collecting surface to form a thread, and
6. drawing off the thread while holding it against rotation.

2. The method of claim 1, further comprising the steps of causing the twisting of the sliver to roll the sliver on the collecting surface and continuously moving the collecting surface to assist the rolling of the sliver on the surface.

* * * * *